US006388547B1

(12) United States Patent
Castonguay et al.

(10) Patent No.: US 6,388,547 B1
(45) Date of Patent: May 14, 2002

(54) CIRCUIT INTERRUPTER OPERATING MECHANISM

(75) Inventors: Roger N. Castonguay, Terryville; Dave S. Christensen, Burlington; Randy Greenberg, Granby; Girish Hassan, Plainville; Dean A. Robarge, Southington, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,567

(22) Filed: Sep. 20, 2001

Related U.S. Application Data

(62) Division of application No. 09/516,475, filed on Mar. 1, 2000.

(51) Int. Cl.[7] ..... H01H 9/00

(52) U.S. Cl. ..... 335/172; 335/167

(58) Field of Search ..... 335/23–25, 167–176; 200/400–401

(56) References Cited

U.S. PATENT DOCUMENTS

| | | | |
|---|---|---|---|
| 2,340,682 | A | 1/1944 | Powell |
| 2,719,203 | A | 9/1955 | Gelzheiser et al. |
| 2,937,254 | A | 5/1960 | Ericson |
| 3,105,048 | A | 9/1963 | Bobrowsky |
| 3,155,802 | A | 11/1964 | Wortmann |
| 3,158,717 | A | 11/1964 | Jencks et al. |
| 3,162,739 | A | 12/1964 | Klein et al. |
| 3,197,582 | A | 7/1965 | Norden |
| 3,307,002 | A | 2/1967 | Cooper |
| 3,624,329 | A | 11/1968 | Fischer |
| 3,517,356 | A | 9/1970 | Hanafusa |
| 3,631,369 | A | 12/1971 | Menocal |
| 3,803,455 | A | 4/1974 | Willard |
| 3,883,781 | A | 5/1975 | Cotton |

(List continued on next page.)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 555 158 | 9/1983 |

(List continued on next page.)

*Primary Examiner*—Lincoln Donovan
(74) *Attorney, Agent, or Firm*—Cantor Colburn LLP

(57) ABSTRACT

An operating mechanism controls and trips a separable contact structure arranged in a protected circuit. The mechanism includes a frame, a drive member pivotally coupled to the frame, a spring pivotally connecting the drive member to a drive connector, an upper link pivotally seated on the drive connector, a lower link member pivotally coupled to the drive connector, a crank member pivotally coupled to the lower link member for interfacing the separable contact structure, and a cradle member pivotally secured to the frame and pivotally securing the upper link. The cradle member is configured for being releasably engaged by a latch assembly, which is displaced upon occurrence of a predetermined condition in the circuit such as a trip condition. The mechanism is movable between a tripped position, a reset position, an off position, and an on position. Spacers are operatively positioned between movable members, and protrusions are operatively formed on the enclosure of the contact structure. The spacers and protrusions serve to widen the stances of the operating mechanism for force distribution purposes, and also to minimize friction between movable components.

2 Claims, 15 Drawing Sheets

U.S. PATENT DOCUMENTS

| | | | |
|---|---|---|---|
| 4,129,762 | A | 12/1978 | Bruchet |
| 4,144,513 | A | 3/1979 | Shafer et al. |
| 4,158,119 | A | 6/1979 | Krakik |
| 4,165,453 | A | 8/1979 | Hennemann |
| 4,166,988 | A | 9/1979 | Ciarcia et al. |
| 4,220,934 | A | 9/1980 | Wafer et al. |
| 4,255,732 | A | 3/1981 | Wafer et al. |
| 4,259,651 | A | 3/1981 | Yamat |
| 4,263,492 | A | 4/1981 | Maier et al. |
| 4,276,527 | A | 6/1981 | Gerbert-Gaillard et al. |
| 4,297,663 | A | 10/1981 | Seymour et al. |
| 4,301,342 | A | 11/1981 | Castonguay et al. |
| 4,360,852 | A | 11/1982 | Gilmore |
| 4,368,444 | A | 1/1983 | Preuss et al. |
| 4,375,021 | A | 2/1983 | Pardini et al. |
| 4,375,022 | A | 2/1983 | Daussin et al. |
| 4,376,270 | A | 3/1983 | Staffen |
| 4,383,146 | A | 5/1983 | Bur |
| 4,392,036 | A | 7/1983 | Troebel et al. |
| 4,393,283 | A | 7/1983 | Masuda |
| 4,401,872 | A | 8/1983 | Boichot-Castagne et al. |
| 4,409,573 | A | 10/1983 | DiMarco et al. |
| 4,435,690 | A | 3/1984 | Link et al. |
| 4,467,297 | A | 8/1984 | Boichot-Castagne et al. |
| 4,468,645 | A | 8/1984 | Gerbert-Gaillard et al. |
| 4,470,027 | A | 9/1984 | Link et al. |
| 4,479,143 | A | 10/1984 | Watanabe et al. |
| 4,488,133 | A | 12/1984 | McClellan et al. |
| 4,492,941 | A | 1/1985 | Nagel |
| 4,541,032 | A | 9/1985 | Schwab |
| 4,546,224 | A | 10/1985 | Mostosi |
| 4,550,360 | A | 10/1985 | Dougherty |
| 4,562,419 | A | 12/1985 | Preuss et al. |
| 4,589,052 | A | 5/1986 | Dougherty |
| 4,595,812 | A | 6/1986 | Tamaru et al. |
| 4,611,187 | A | 9/1986 | Banfi |
| 4,612,430 | A | 9/1986 | Sloan et al. |
| 4,616,198 | A | 10/1986 | Pardini |
| 4,622,444 | A | 11/1986 | Kandatsu et al. |
| 4,631,625 | A | 12/1986 | Alexander et al. |
| 4,642,431 | A | 2/1987 | Tedesco et al. |
| 4,644,438 | A | 2/1987 | Puccinelli et al. |
| 4,649,247 | A | 3/1987 | Preuss et al. |
| 4,658,322 | A | 4/1987 | Rivera |
| 4,672,501 | A | 6/1987 | Bilac et al. |
| 4,675,481 | A | 6/1987 | Markowski et al. |
| 4,682,264 | A | 7/1987 | Demeyer |
| 4,689,712 | A | 8/1987 | Demeyer |
| 4,694,373 | A | 9/1987 | Demeyer |
| 4,710,845 | A | 12/1987 | Demeyer |
| 4,717,985 | A | 1/1988 | Demeyer |
| 4,733,211 | A | 3/1988 | Castonguay et al. |
| 4,733,321 | A | 3/1988 | Lindeperg |
| 4,764,650 | A | 8/1988 | Bur et al. |
| 4,768,007 | A | 8/1988 | Mertz et al. |
| 4,780,786 | A | 10/1988 | Weynachter et al. |
| 4,831,221 | A | 5/1989 | Yu et al. |
| 4,870,531 | A | 9/1989 | Danek |
| 4,883,931 | A | 11/1989 | Batteux et al. |
| 4,884,047 | A | 11/1989 | Baginski et al. |
| 4,884,164 | A | 11/1989 | Dziura et al. |
| 4,900,882 | A | 2/1990 | Bernard et al. |
| 4,910,485 | A | 3/1990 | Bolongeat-Mobleu et al. |
| 4,914,541 | A | 4/1990 | Tripodi et al. |
| 4,916,420 | A | 4/1990 | Bartolo et al. |
| 4,916,421 | A | 4/1990 | Pardini et al. |
| 4,926,282 | A | 5/1990 | McGhie |
| 4,935,590 | A | 6/1990 | Malkin et al. |
| 4,937,706 | A | 6/1990 | Schueller et al. |
| 4,939,492 | A | 7/1990 | Raso et al. |
| 4,943,691 | A | 7/1990 | Mertz et al. |
| 4,943,888 | A | 7/1990 | Jacob et al. |
| 4,950,855 | A | 8/1990 | Bolonegeat-Mobleu et al. |
| 4,951,019 | A | 8/1990 | Gula |
| 4,952,897 | A | 8/1990 | Barnel et al. |
| 4,958,135 | A | 9/1990 | Baginski et al. |
| 4,965,543 | A | 10/1990 | Batteux |
| 4,935,712 | A | 11/1990 | Kazuaki et al. |
| 4,983,788 | A | 1/1991 | Pardini |
| 5,001,313 | A | 3/1991 | Leclerq et al. |
| 5,004,878 | A | 4/1991 | Seymour et al. |
| 5,029,301 | A | 7/1991 | Nebon et al. |
| 5,030,804 | A | 7/1991 | Abri |
| 5,057,655 | A | 10/1991 | Kersusan et al. |
| 5,077,627 | A | 12/1991 | Fraisse |
| 5,083,081 | A | 1/1992 | Barrault et al. |
| 5,095,183 | A | 3/1992 | Raphard et al. |
| 5,103,198 | A | 4/1992 | Morel et al. |
| 5,115,371 | A | 5/1992 | Tripodi |
| 5,120,921 | A | 6/1992 | DiMarco et al. |
| 5,132,865 | A | 7/1992 | Mertz et al. |
| 5,138,121 | A | 8/1992 | Streich et al. |
| 5,140,115 | A | 8/1992 | Morris |
| 5,153,802 | A | 10/1992 | Mertz et al. |
| 5,155,315 | A | 10/1992 | Malkin et al. |
| 5,166,483 | A | 11/1992 | Kersusan et al. |
| 5,178,504 | A | 1/1993 | Falchi |
| 5,184,717 | A | 2/1993 | Chou et al. |
| 5,187,339 | A | 2/1993 | Lissandrin |
| 5,198,956 | A | 3/1993 | Dvorak |
| 5,200,724 | A | 4/1993 | Gula et al. |
| 5,210,385 | A | 5/1993 | Morel et al. |
| 5,239,150 | A | 8/1993 | Bolongeat-Mobleu et al. |
| 5,260,533 | A | 11/1993 | Livesey et al. |
| 5,262,744 | A | 11/1993 | Arnold et al. |
| 5,280,144 | A | 1/1994 | Bolongeat-Mobleu et al. |
| 5,281,776 | A | 1/1994 | Morel et al. |
| 5,296,660 | A | 3/1994 | Morel et al. |
| 5,296,664 | A | 3/1994 | Crookston et al. |
| 5,298,874 | A | 3/1994 | Morel et al. |
| 5,300,907 | A | 4/1994 | Nereau et al. |
| 5,310,971 | A | 5/1994 | Vial et al. |
| 5,313,180 | A | 5/1994 | Vial et al. |
| 5,317,471 | A | 5/1994 | Izoard et al. |
| 5,331,500 | A | 7/1994 | Corcoles et al. |
| 5,334,808 | A | 8/1994 | Bur et al. |
| 5,341,191 | A | 8/1994 | Crookston et al. |
| 5,347,096 | A | 9/1994 | Bolongeat-Mobleu et al. |
| 5,347,097 | A | 9/1994 | Bolongeat-Mobleu et al. |
| 5,350,892 | A | 9/1994 | Rozier |
| 5,357,066 | A | 10/1994 | Morel et al. |
| 5,357,068 | A | 10/1994 | Rozier |
| 5,357,394 | A | 10/1994 | Piney |
| 5,361,052 | A | 11/1994 | Ferullo et al. |
| 5,373,130 | A | 12/1994 | Barrault et al. |
| 5,379,013 | A | 1/1995 | Coudert |
| 5,424,701 | A | 6/1995 | Castonguary et al. |
| 5,438,176 | A | 8/1995 | Bonnardel et al. |
| 5,440,088 | A | 8/1995 | Coudert et al. |
| 5,449,871 | A | 9/1995 | Batteux et al. |
| 5,450,048 | A | 9/1995 | Leger et al. |
| 5,451,729 | A | 9/1995 | Onderka et al. |
| 5,457,295 | A | 10/1995 | Tanibe et al. |
| 5,467,069 | A | 11/1995 | Payet-Burin et al. |
| 5,469,121 | A | 11/1995 | Payet-Burin |
| 5,475,558 | A | 12/1995 | Barjonnet et al. |
| 5,477,016 | A | 12/1995 | Baginski et al. |
| 5,479,143 | A | 12/1995 | Payet-Burin |
| 5,483,212 | A | 1/1996 | Lankuttis et al. |

| | | | | | |
|---|---|---|---|---|---|
| 5,485,343 | A | | 1/1996 | Santos et al. | |
| D367,265 | S | | 2/1996 | Yamagata et al. | |
| 5,493,083 | A | | 2/1996 | Olivier | |
| 5,504,284 | A | | 4/1996 | Lazareth et al. | |
| 5,504,290 | A | | 4/1996 | Baginski et al. | |
| 5,510,761 | A | | 4/1996 | Boder et al. | |
| 5,512,720 | A | | 4/1996 | Coudert et al. | |
| 5,515,018 | A | | 5/1996 | DiMarco et al. | |
| 5,519,561 | A | | 5/1996 | Mrenna et al. | |
| 5,534,674 | A | | 7/1996 | Steffens | |
| 5,534,832 | A | | 7/1996 | Duchemin et al. | |
| 5,534,835 | A | | 7/1996 | McColloch et al. | |
| 5,534,840 | A | | 7/1996 | Cuingnet | |
| 5,539,168 | A | | 7/1996 | Linzenich | |
| 5,543,595 | A | | 8/1996 | Mader et al. | |
| 5,552,755 | A | | 9/1996 | Fello et al. | |
| 5,581,219 | A | | 12/1996 | Nozawa et al. | |
| 5,604,656 | A | | 2/1997 | Derrick et al. | |
| 5,608,367 | A | | 3/1997 | Zoller et al. | |
| 5,784,233 | A | | 7/1998 | Bastard et al. | |
| 5,791,457 | A | | 8/1998 | Castonguay et al. | |
| 6,084,191 | A | * | 7/2000 | Kataya et al. | 200/401 |
| 6,172,584 | B1 | * | 1/2001 | Castonguay et al. | 335/172 |
| 6,201,460 | B1 | * | 3/2001 | Winslett et al. | 335/172 |

FOREIGN PATENT DOCUMENTS

| | | | |
|---|---|---|---|
| EP | 0 117 094 | | 8/1984 |
| EP | 0 140 761 | | 5/1985 |
| EP | 0 174 904 | | 3/1986 |
| EP | 0 196 241 | | 10/1986 |
| EP | 0 224 396 | | 6/1987 |
| EP | 0 235 479 | | 9/1987 |
| EP | 0 239 460 | | 9/1987 |
| EP | 0 258 090 | | 3/1988 |
| EP | 0 264 313 | | 4/1988 |
| EP | 0 264 314 | | 4/1988 |
| EP | 0 283 189 | | 9/1988 |
| EP | 0 283 358 | | 9/1988 |
| EP | 0 291 374 | | 11/1988 |
| EP | 0 295 155 | | 12/1988 |
| EP | 0 295 158 | | 12/1988 |
| EP | 0 309 923 | | 4/1989 |
| EP | 0 313 106 | | 4/1989 |
| EP | 0 313 422 | | 4/1989 |
| EP | 0 314 540 | | 5/1989 |
| EP | 0 331 586 | | 9/1989 |
| EP | 0 337 900 | | 10/1989 |
| EP | 0 342 133 | | 11/1989 |
| EP | 0 367 690 | | 5/1990 |
| EP | 0 371 887 | | 6/1990 |
| EP | 0 375 568 | | 6/1990 |
| EP | 0 394 144 | | 10/1990 |
| EP | 0 394 922 | | 10/1990 |
| EP | 0 399 282 | | 11/1990 |
| EP | 0 407 31 | | 1/1991 |
| EP | 0 452 230 | | 10/1991 |
| EP | 0555158 | | 8/1993 |
| EP | 0 560 697 | | 9/1993 |
| EP | 0 567 416 | | 10/1993 |
| EP | 0 595 730 | | 5/1994 |
| EP | 0 619 591 | | 10/1994 |
| EP | 0 665 569 | | 8/1995 |
| EP | 0 700 140 | | 3/1996 |
| EP | 0889498 | A2 | 6/1998 |
| EP | 0 889 498 | | 1/1999 |
| FR | 2171863 | | 8/1973 |
| FR | 2 410 353 | | 6/1979 |
| FR | 2 512 582 | | 3/1983 |
| FR | 2 553 943 | | 4/1985 |
| FR | 2 592 998 | | 7/1987 |
| FR | 2 682 531 | | 4/1993 |
| FR | 2682531 | | 4/1993 |
| FR | 2 697 670 | | 5/1994 |
| FR | 2 699 324 | | 6/1994 |
| FR | 2 714 771 | | 7/1995 |
| GB | 2 233 155 | | 1/1991 |
| WO | 92/00598 | | 1/1992 |
| WO | 92/05649 | | 4/1992 |
| WO | 94/00901 | | 1/1994 |

* cited by examiner

CIRCUIT INTERRUPTER OPERATING MECHANISM

CROSS REFERENCE TO RELATED APPLICATIONS

This Application is a divisional application of U.S. application Ser. No. 09/516,475 filed Mar. 1, 2000, which is hereby incorporated by reference in its entirety.

BACKGROUND OF INVENTION

The present invention is directed to circuit interrupters, and more particularly to circuit interrupter operating mechanisms.

Circuit interrupter operating mechanisms are used to manually control the opening and closing of movable contact structures within circuit interrupters. Additionally, these operating mechanisms in response to a trip signal, for example, from an actuator device, will rapidly open the movable contact structure and interrupt the circuit. To transfer the forces (e.g., to manually control the contact structure or to rapidly trip the structure with an actuator), operating mechanisms employ powerful springs and linkage arrangements. The spring energy provides a high output force to the separable contacts.

Commonly, multiple contacts, each disposed within a cassette, are arranged within a circuit breaker system for protection of individual phases of current. The operating mechanism is positioned over one of the cassettes and generally connected to all of the cassettes in the system. Because of the close position between each of the cassettes, and between each cassette and the operating mechanism, the space available for movable components is minimal. It would be desirable to maximize the available space to reduce friction between movable components within the operating mechanism.

Furthermore, circuit breaker arrangements are provided for 3-pole and 4-pole devices. Inherently, the position of a circuit breaker operating mechanism relative to a 4-pole device is asymmetrical. Therefore, it will be desirable to provide a circuit breaker operating mechanism that maximizes the output force to the poles of the circuit breaker system while minimizing the lost forces due to, for example, friction.

SUMMARY OF INVENTION

An operating mechanism for controlling and tripping a separable contact structure arranged in a protected circuit is provided by the present invention. The separable contact structure is movable between a first and second position. The first position permits current to flow through the protected circuit and the second position prohibits current from flowing through the circuit. The mechanism includes a frame, a drive member pivotally coupled to the frame, a spring pivotally connecting the drive member to a drive connector, an upper link pivotally seated on the drive connector, a lower link member pivotally coupled to the drive connector, a crank member pivotally coupled to the lower link member for interfacing the separable contact structure, and a cradle member pivotally secured to the frame and pivotally securing the upper link. The cradle member is configured for being releasably engaged by a latch assembly, which is displaced upon occurrence of a predetermined condition in the circuit. The mechanism is movable between a tripped position, a reset position, an off position, and an on position.

In one exemplary embodiment, spacers are operatively positioned between movable members, and protrusions are operatively formed on the enclosure. The spacers and protrusions serve to widen the stances of the operating mechanism for force distribution purposes, and also to minimize friction between movable components.

DETAILED DESCRIPTION

Figure 1:
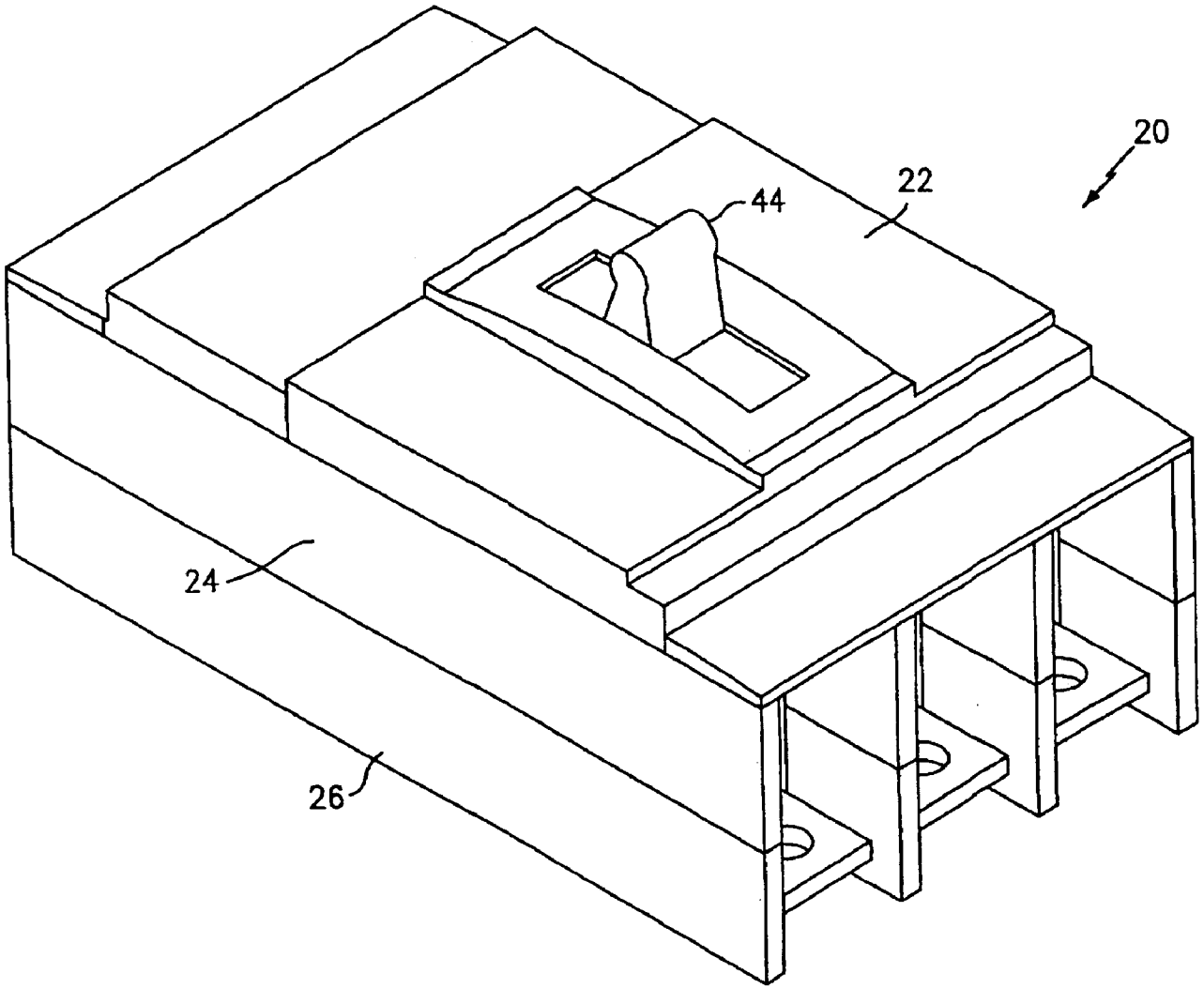
FIG. 1 is an isometric view of a molded case circuit breaker employing an operating mechanism embodied by the present invention.
Figure 2:
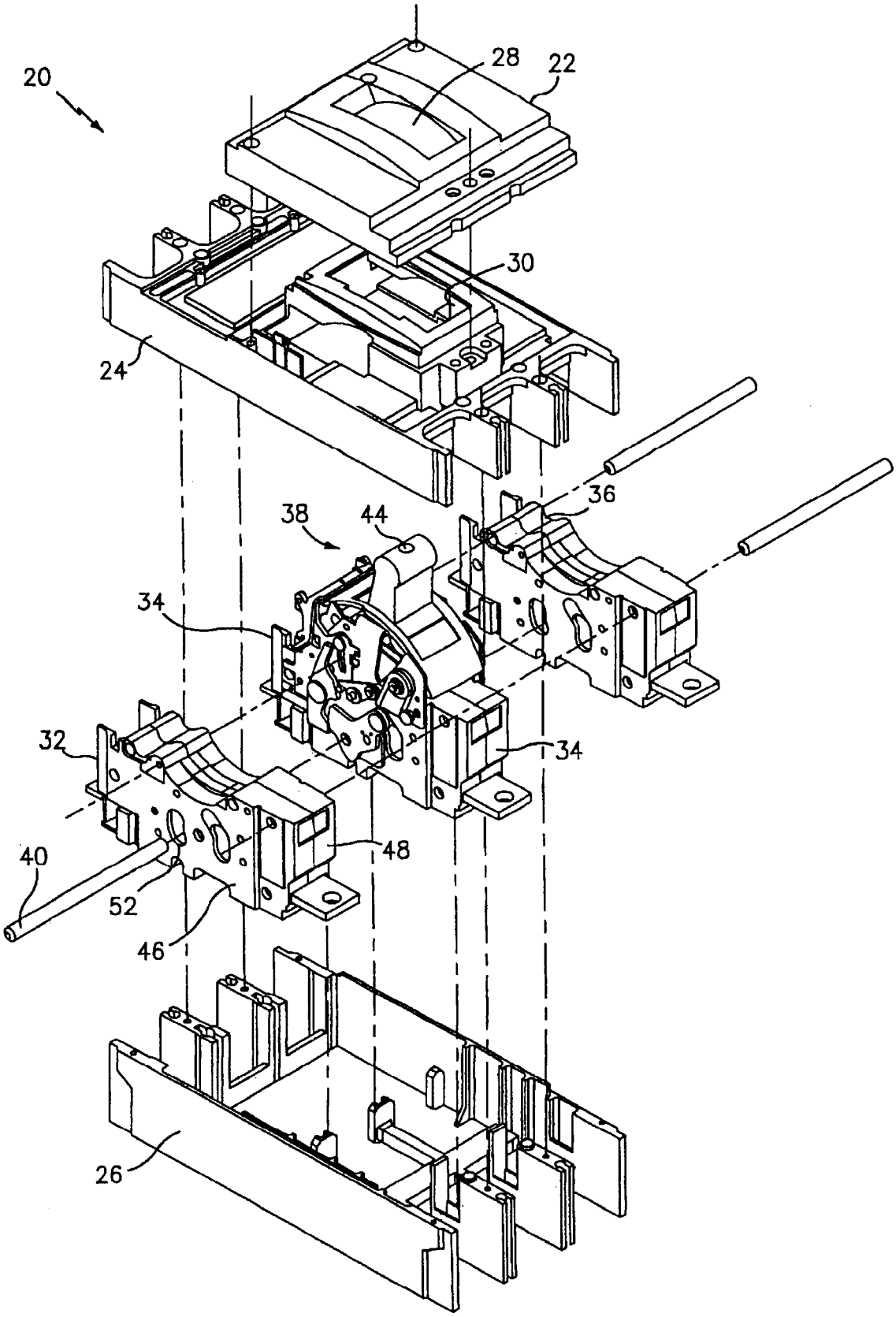
FIG. 2 is an exploded view of the circuit breaker of FIG. 1.

In an exemplary embodiment of the present invention, and referring to FIGS. 1 and 2, a circuit breaker 20 is shown. Circuit breaker 20 generally includes a molded case having a top cover 22 attached to a mid cover 24 coupled to a base 26. An opening 28, formed generally centrally within top cover 22, is positioned to mate with a corresponding mid cover opening 30, which is accordingly aligned with opening 28 when mid cover 24 and top cover 22 are coupled to one another.

In a 3-pole system (i.e., corresponding with three phases of current), three rotary cassettes 32, 34 and 36 are disposed within base 26. Cassettes 32, 34 and 36 are commonly operated by an interface between an operating mechanism 38 via a cross pin 40. Operating mechanism 38 is positioned and configured atop cassette 34, which is generally disposed intermediate to cassettes 32 and 36. Operating mechanism 38 operates substantially as described herein and as described in U.S. patent application Ser. No. 09/196,706 entitled "Circuit Breaker Mechanism for a Rotary Contact Assembly."

A toggle handle 44 extends through openings 28 and 30 and allows for external operation of cassettes 32, 34 and 36. Examples of rotary contact structures that may be operated by operating mechanism 38 are described in more detail in U.S. patent application Ser. Nos. 09/087,038 and 09/384,908, both entitled "Rotary Contact Assembly For High-Ampere Rated Circuit Breakers", and U.S. patent application Ser. No. 09/384,495, entitled "Supplemental Trip Unit For Rotary Circuit Interrupters". Cassettes 32, 34, 36 are typically formed of high strength plastic material and each include opposing sidewalls 46, 48. Sidewalls 46, 48 have an arcuate slot 52 positioned and configured to receive and allow the motion of cross pin 40 by action of operating mechanism 38.

Figure 3:
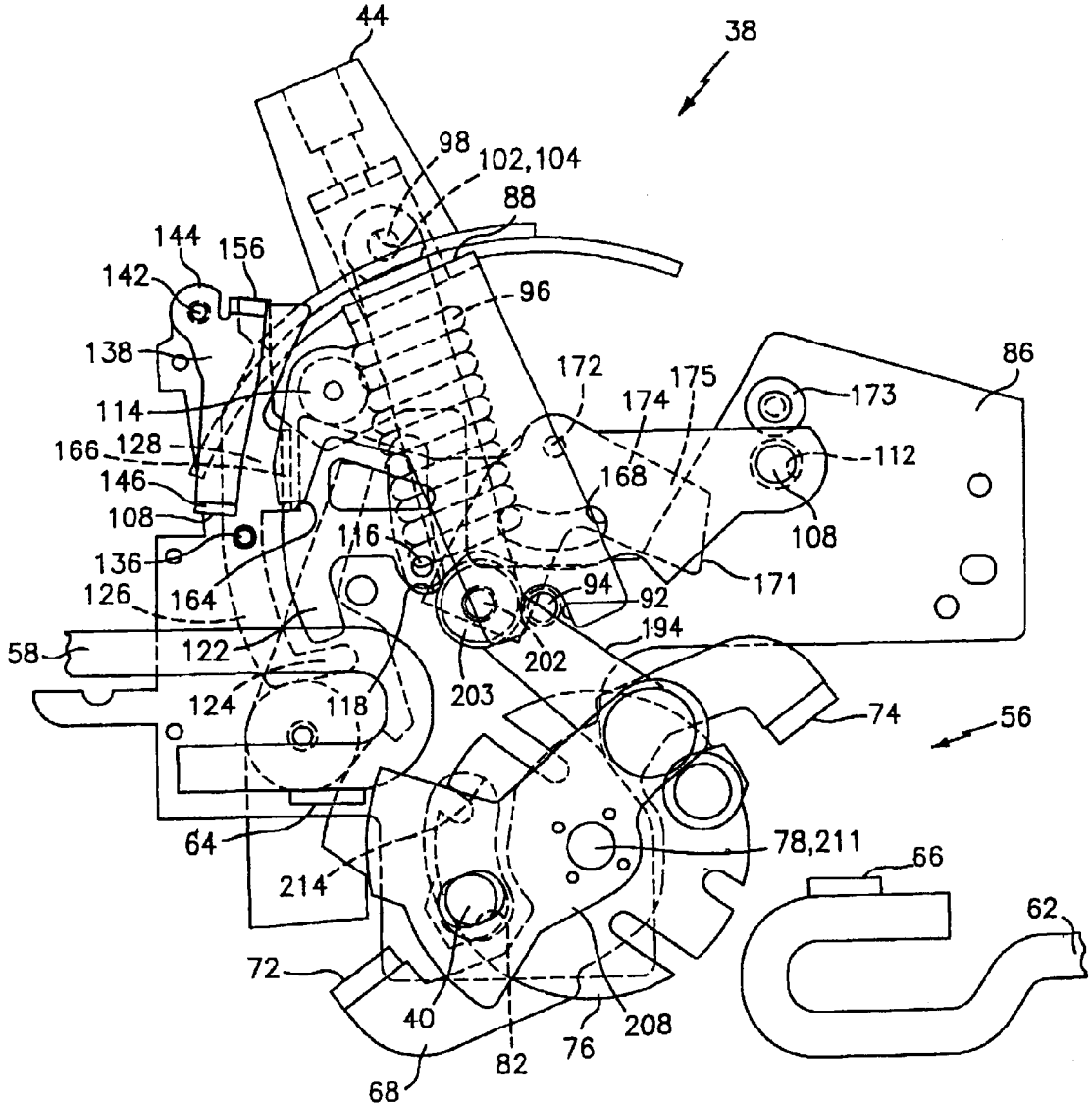
FIG. 3 is a partial sectional view of a rotary contact structure and operating mechanism embodied by the present invention in the "off" position.
Figure 4:
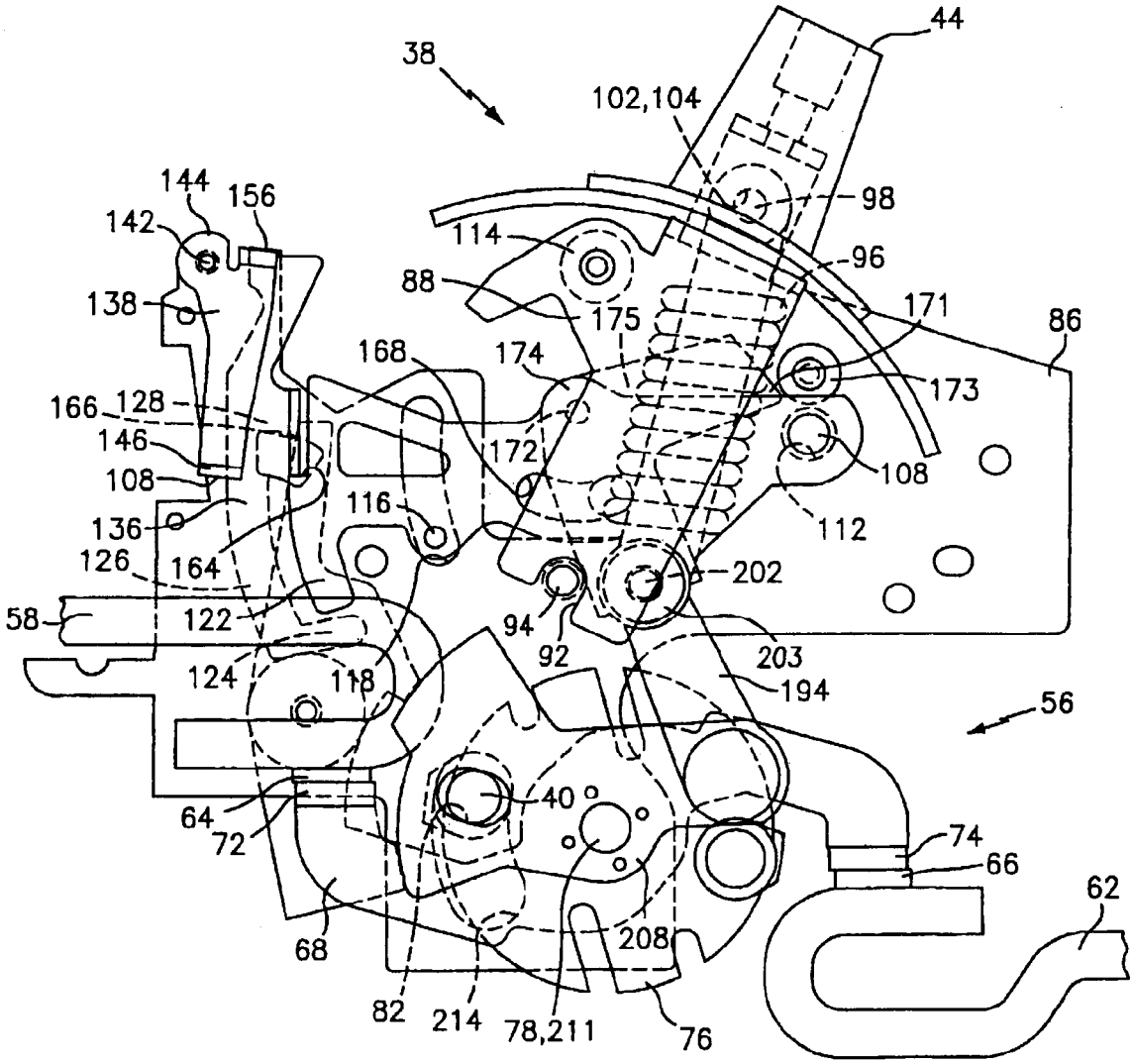
FIG. 4 is a partial sectional view of the rotary contact structure and operating mechanism of FIG. 3 in the "on" position.
Figure 5:
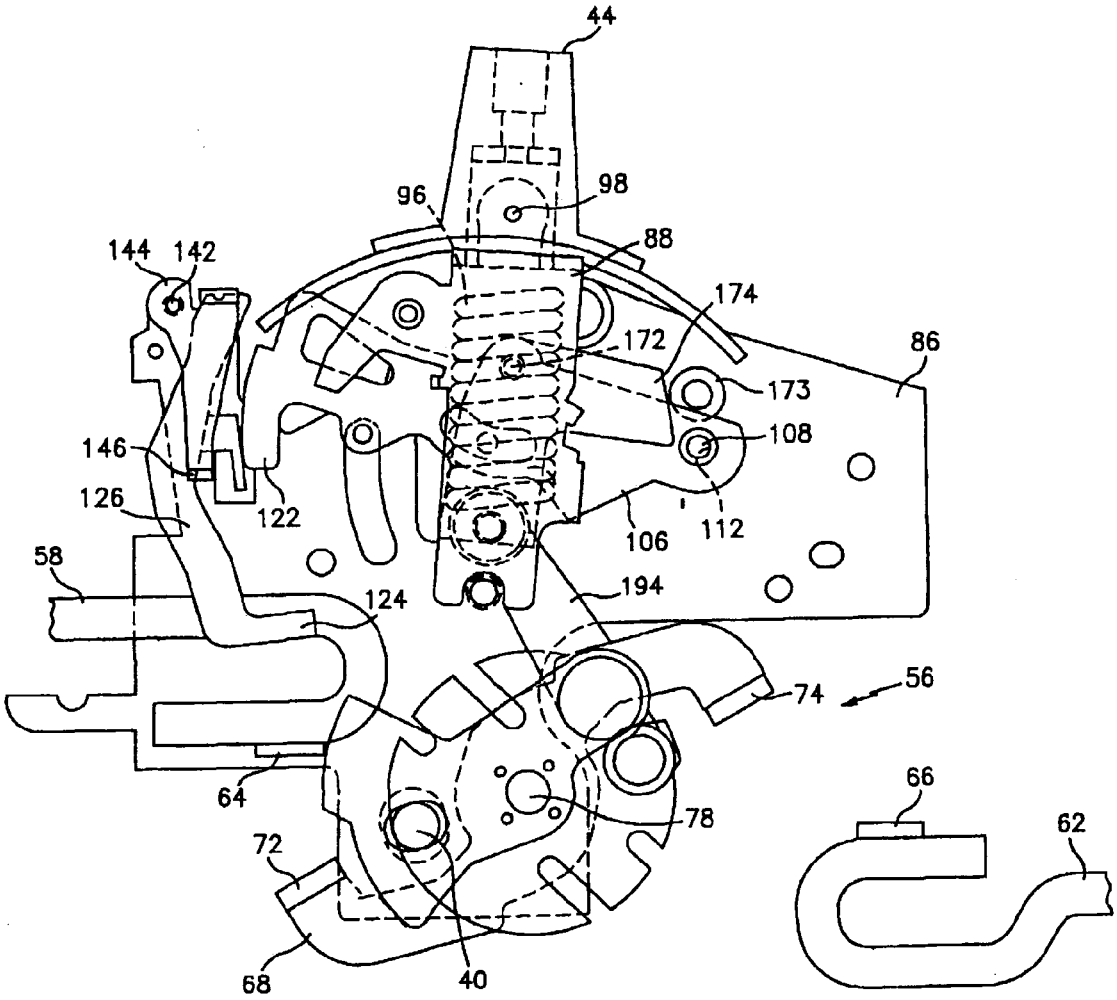
FIG. 5 is a partial sectional view of the rotary contact structure and operating mechanism of FIGS. 3 and 4 in the "tripped" position.

Referring now to FIGS. 3, 4, and 5, an exemplary rotary contact assembly 56 that is disposed within each cassette 32, 34, 36 is shown in the "off", "on" and "tripped" conditions, respectively. Also depicted are partial side views of operating mechanism 38, the components of which are described in greater detail further herein. Rotary contact assembly 56 includes a line side contact strap 58 and load side contact strap 62 for connection with a power source and a protected circuit (not shown), respectively. Line side contact strap 58 includes a stationary contact 64 and load side contact strap 62 includes a stationary contact 66. Rotary contact assembly 56 further includes a movable contact arm 68 having a set of contacts 72 and 74 that mate with stationary contacts 64 and 66, respectively. In the "off" position (FIG. 3) of operating mechanism 38, wherein toggle handle 44 is oriented to the left (e.g., via a manual or mechanical force), contacts 72 and 74 are separated from stationary contacts 64 and 66, thereby preventing current from flowing through contact arm 68.

In the "on" position (FIG. 4) of operating mechanism 38, wherein toggle handle 44 is oriented to the right as depicted in FIG. 3 (e.g., via a manual or mechanical force), contacts 72 and 74 are mated with stationary contacts 64 and 66, thereby allowing current to flow through contact arm 68. In the "tripped" position (FIG. 5) of operating mechanism 38, toggle handle 44 is oriented between the "on" position and the "off" position (typically by the release of mechanism springs within operating mechanism 38, described in greater detail herein). In this "tripped" position, contacts 72 and 74 are separated from stationary contacts 64 and 66 the action of operating mechanism 38, thereby preventing current from flowing through contact arm 68. After operating mechanism 38 is in the "tripped" position, it must ultimately be returned to the "on" position for operation. This is effectuated by applying a reset force to move toggle handle 44 to a "reset" condition, which is beyond the "off" position (i.e., further to the left of the "off" position in FIG. 3), and then back to the "on" position. This reset force must be high enough to overcome the mechanism springs, described herein.

Contact arm 68 is mounted on a rotor structure 76 that houses one or more sets of contact springs (not shown). Contact arm 68 and rotor structure 76 pivot about a common center 78. Cross pin 40 interfaces through an opening 82 within rotor structure 76 generally to cause contact arm 68 to be moved from the "on", "off" and "tripped" position.

Figure 6:
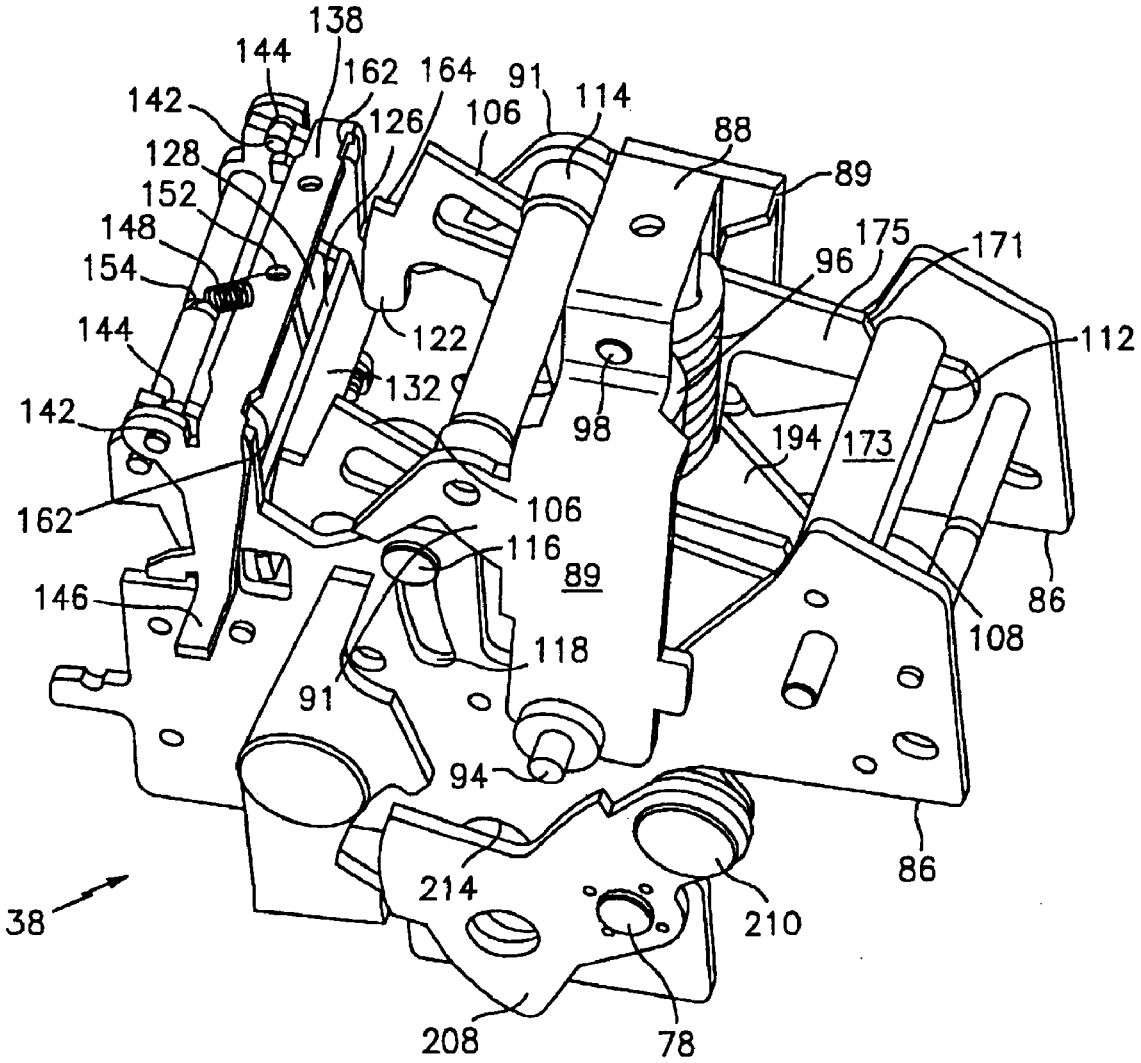
FIG. 6 is an isometric view of the operating mechanism.
Figure 7:
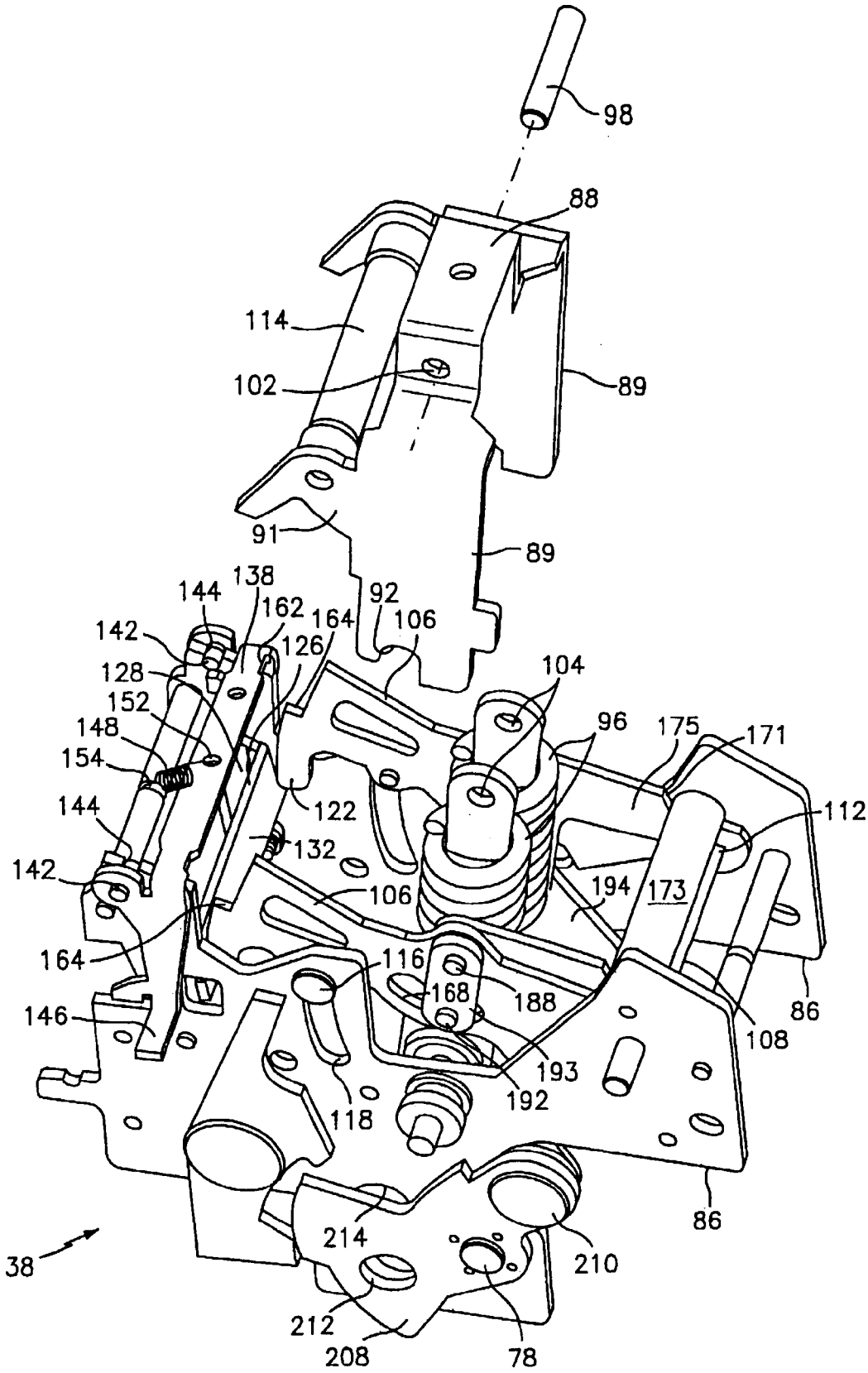
FIG. 7 is a partially exploded view of the operating mechanism.
Figure 8:
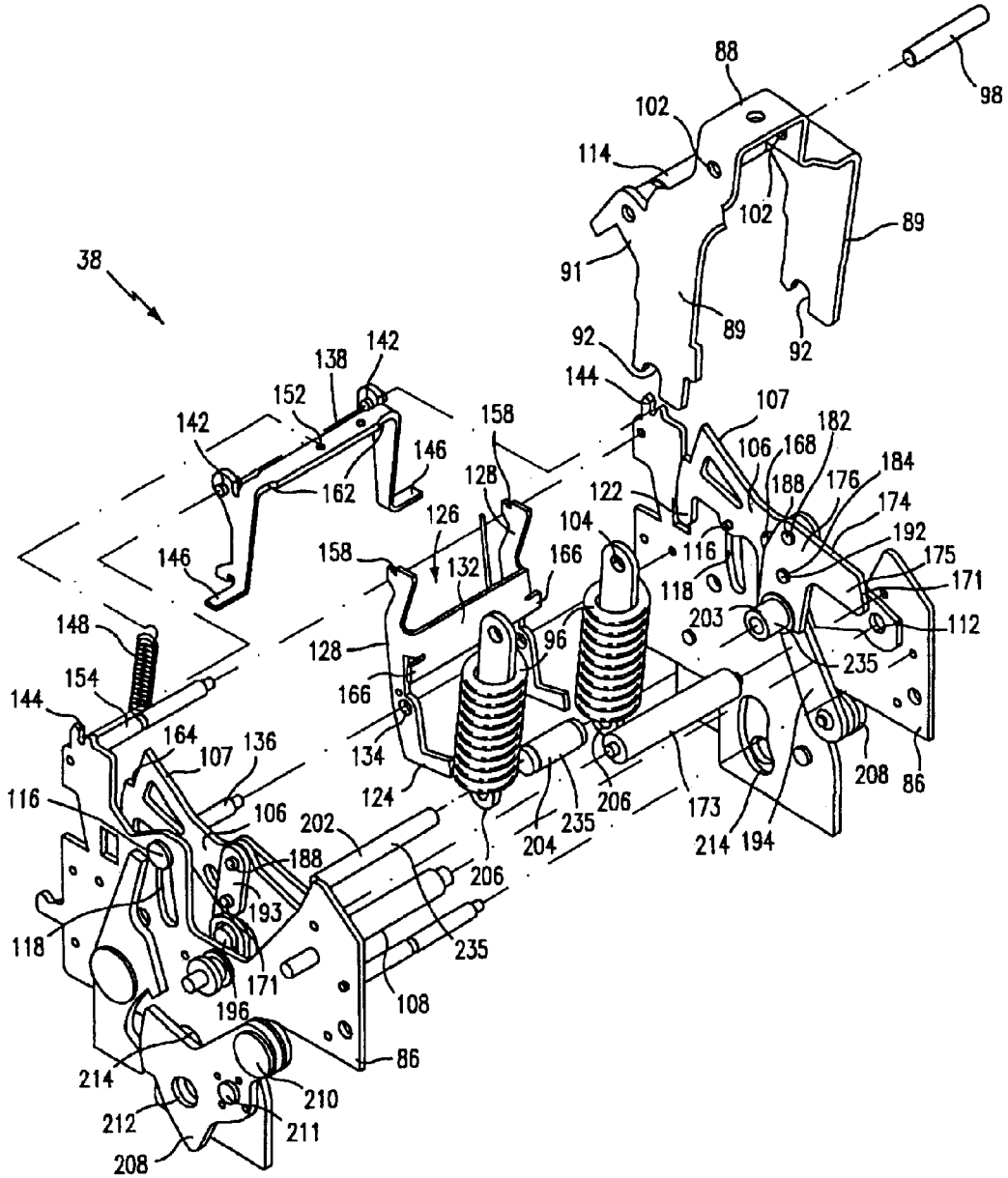
FIG. 8 is another partially exploded view of the operating mechanism.

Referring now to FIGS. 6–8, the components of operating mechanism 38 will now be detailed. As viewed in FIGS. 6–8, operating mechanism 38 is in the "tripped" position. Operating mechanism 38 has operating mechanism side frames 86 configured and positioned to straddle sidewalls 46, 48 of cassette 34 (FIG. 2).

Toggle handle 44 (FIG. 2) is rigidly interconnected with a drive member or handle yoke 88. Handle yoke 88 includes opposing side portions 89. Each side portion 89 includes an extension 91 at to the top of side portion 89, and a U-shaped portion 92 at the bottom portion of each side portion 89. U-shaped portions 92 are rotatably positioned on a pair of bearing portions 94 protruding outwardly from side frames 86. Bearing portions 94 are configured to retain handle yoke 88, for example, with a securement washer. Handle yoke 88 further includes a roller pin 114 extending between extensions 91.

Handle yoke 88 is connected to a set of powerful mechanism springs 96 by a spring anchor 98, which is generally supported within a pair of openings 102 in handle yoke 88 and arranged through a complementary set of openings 104 on the top portion of mechanism springs 96.

Figure 9:
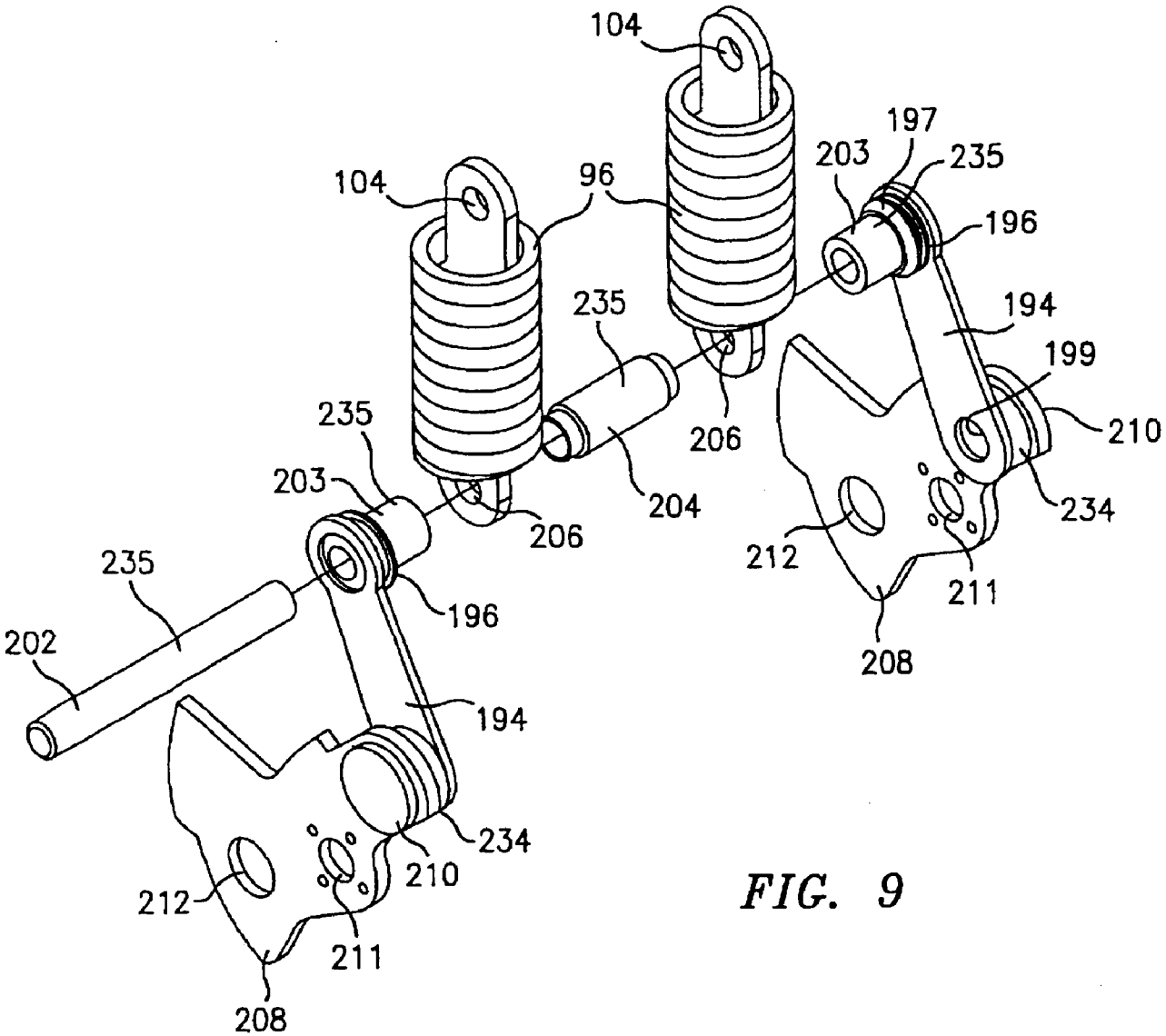
FIG. 9 is an exploded view of a pair of mechanism springs and associated linkage components within the operating mechanism.

Referring to FIG. 9, the bottom portion of mechanism springs 96 include a pair of openings 206. A drive connector 201 operative couples mechanism springs 96 to other operating mechanism components. Drive connector 201 comprises a pin 202 disposed through openings 206, a set of side tubes 203 arranged on pin 202 adjacent to the outside surface of the bottom portion of mechanism springs 96, and a central tube 204 arranged on pin 202 between the inside surfaces of the bottom portions of mechanism springs 96. Central tube 204 includes step portions at each end, generally configured to maintain a suitable distance between mechanism springs 96. While drive connector 201 is detailed herein as tubes 203, 204 and a pin 202, any means to connect the springs to the mechanism components are contemplated.

Figure 10:
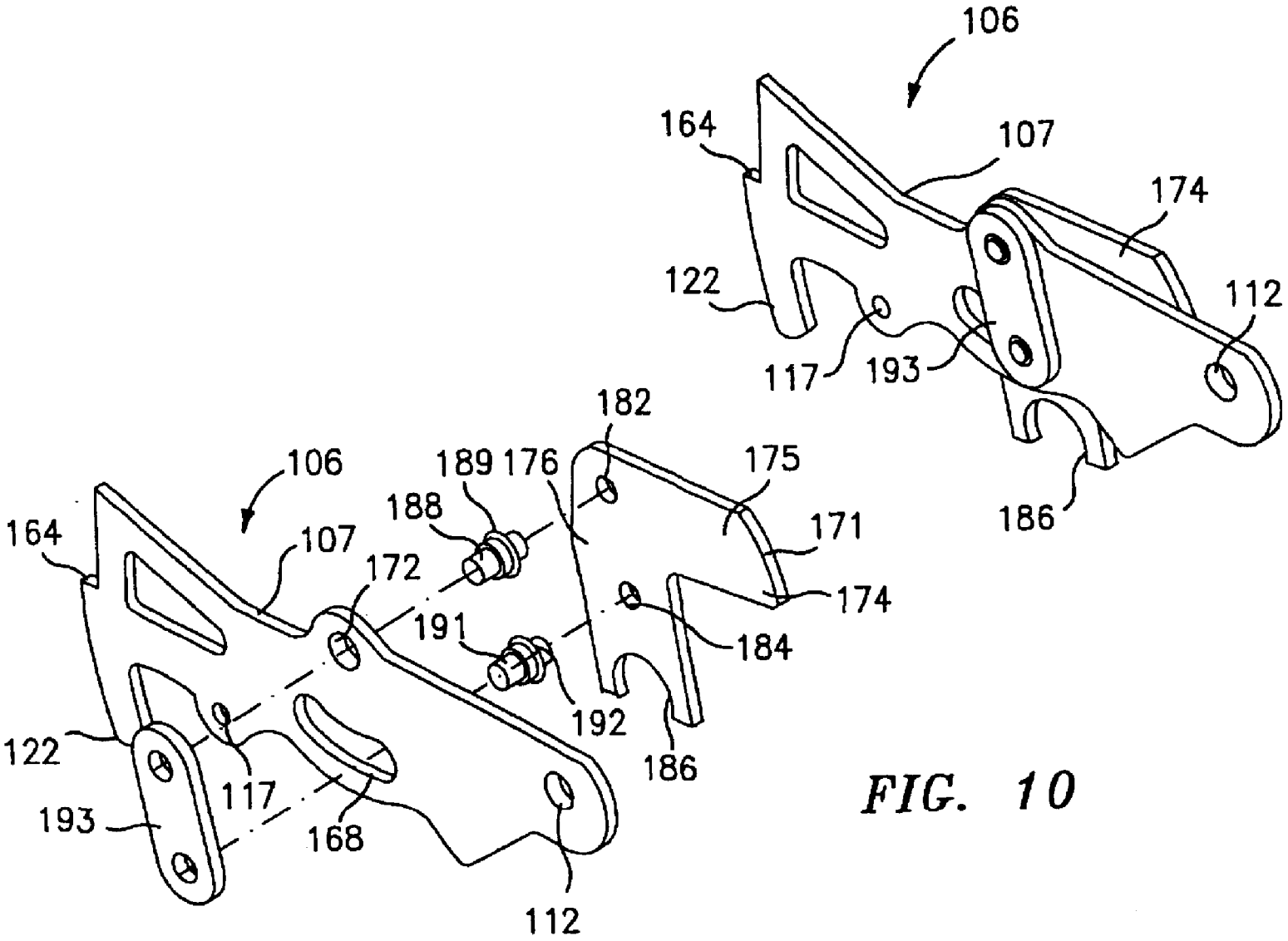
FIG. 10 is an isometric and exploded view of linkage components within the operating mechanism.

Referring to FIGS. 8 and 10, a pair of cradles 106 are disposed adjacent to side frames 86 and pivot on a pin 108 disposed through an opening 112 approximately at the end of each cradle 106. Each cradle 106 includes an edge surface 107, an arm 122 depending downwardly, and a cradle latch surface 164 above arm 122. Edge surface 107 is positioned generally at the portion of cradle 106 in the range of contact with roller pin 114. The movement of each cradle 106 is guided by a rivet 116 disposed through an arcuate slot 118 within each side frame 86. Rivets 116 are disposed within an opening 117 on each the cradle 106. An arcuate slot 168 is positioned intermediate to opening 112 and opening 117 on each cradle 106. An opening 172 is positioned above slot 168.

Referring back to FIGS. 6–8, a primary latch 126 is positioned within side frame 86. Primary latch 126 includes a pair of side portions 128. Each side portion 128 includes a bent leg 124 at the lower portion thereof. Side portions 128 are interconnected by a central portion 132. A set of extensions 166 depend outwardly from central portion 132 positioned to align with cradle latch surfaces 164.

Side portions 128 each include an opening 134 positioned so that primary latch 126 is rotatably disposed on a pin 136. Pin 136 is secured to each side frame 86. A set of upper side portions 156 are defined at the top end of side portions 128. Each upper side portion 156 has a primary latch surface 158.

A secondary latch 138 is pivotally straddled over side frames 86. Secondary latch 138 includes a set of pins 142 disposed in a complementary pair of notches 144 on each side frame 86. Secondary latch 138 includes a pair of secondary latch trip tabs 146 that extend perpendicularly from operating mechanism 38 as to allow an interface with, for example, an actuator (not shown), to release the engagement between primary latch 126 and secondary latch 138 thereby causing operating mechanism 38 to move to the "tripped" position (e.g., as in FIG. 5), described below. Secondary latch 138 includes a set of latch surfaces 162, that align with primary latch surfaces 158.

Secondary latch 138 is biased in the clockwise direction due to the pulling forces of a spring 148. Spring 148 has a first end connected at an opening 152 upon secondary latch 138, and a second end connected at a frame cross pin 154 disposed between frames 86.

Referring to FIGS. 8 and 10, a set of upper links 174 are connected to cradles 106. Upper links 174 generally have a right angle shape. Legs 175 (in a substantially horizontal configuration and FIGS. 8 and 10) of upper links 174 each have a cam portion 171 that interfaces a roller 173 disposed between frames 86. Legs 176 (in a substantially vertical configuration in FIGS. 8 and 10) of upper links 174 each have a pair of openings 182, 184 and a U-shaped portion 186 at the bottom end thereof . Opening 184 is intermediate to opening 182 and U-shaped portion 186. Upper links 174 connect to cradle 106 via a securement structure such as a rivet pin 188 disposed through opening 1 72 and opening 182, and a securement structure such as a rivet pin 191 disposed through slot 168 and opening 184. Rivet pins 188, 191 both attach to a connector 193 to secure each upper link 174 to each cradle 106. Each pin 188, 191 includes raised portions 189, 192, respectively. Raised portions 189, 192 are provided to maintain a space between each upper link 174 and each cradle 106. The space serves to reduce or eliminate friction between upper link 174 and cradle 106 during any operating mechanism motion, and also to spread force loading between cradles 106 and upper links 174.

Figure 11:
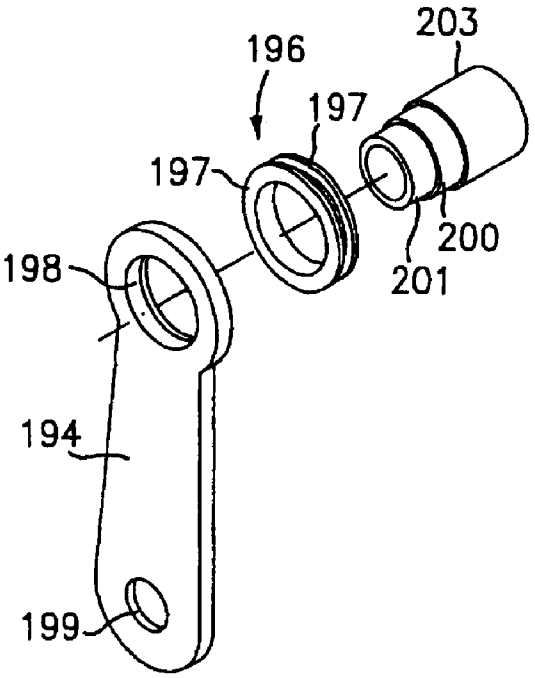
FIG. 11 is a front, isometric, and partially exploded isometric views of a linkage component within the operating mechanism.
Figure 11:
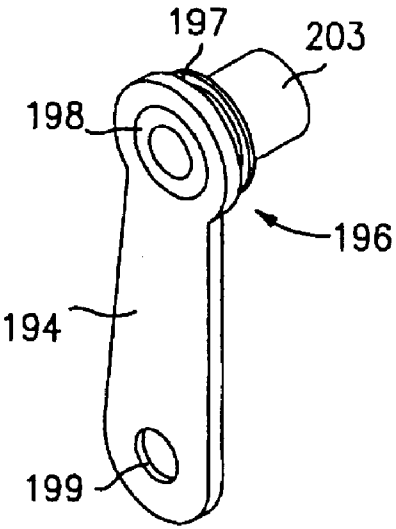
Figure 11:
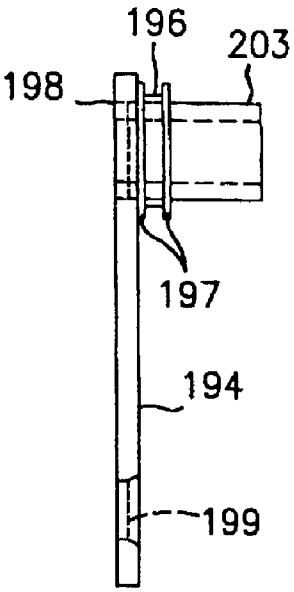

Upper links 174 are each interconnected with a lower link 194. Referring now to FIGS. 8, 10 and 11, U-shaped portion 186 of each upper link 174 is disposed in a complementary set of bearing washers 196. Bearing washers 196 are arranged on each side tube 203 between a first step portion 200 of side tube 203 and an opening 198 at one end of lower link 194. Bearing washers 196 are configured to include side walls 197 spaced apart sufficiently so that U-shaped portions 186 of upper links 174 fit in bearing washer 196. Each side tube 203 is configured to have a second step portion 201. Each second step portion 201 is disposed through openings 198. Pin 202 is disposed through side tubes 203 and central tube 204. Pin 202 interfaces upper links 174 and lower links 194 via side tubes 203. Therefore, each side tube 203 is a common interface point for upper link 174 (as pivotally seated within side walls 197 of bearing washer 196), lower link 194 and mechanism springs 96.

Figure 12:
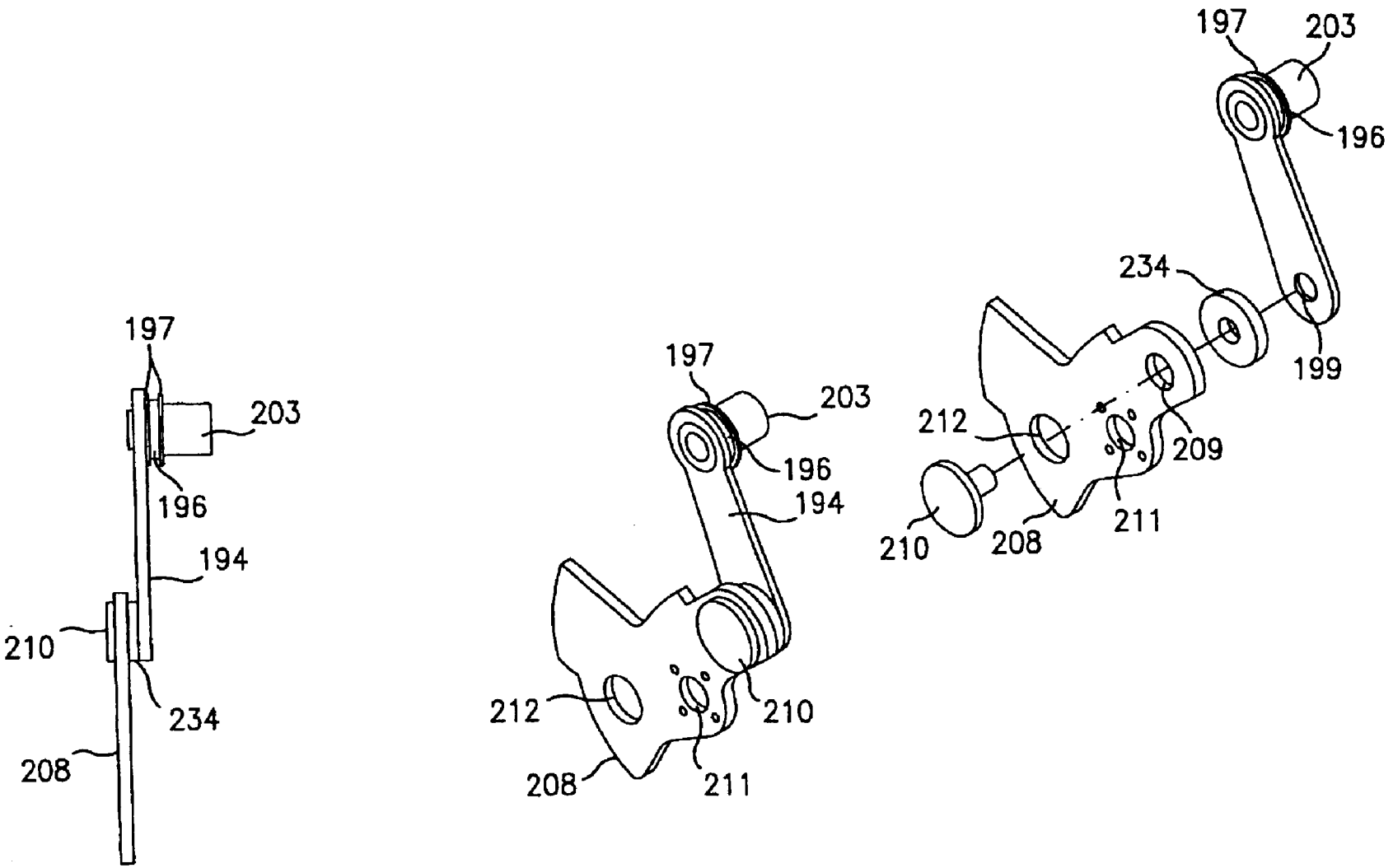
FIG. 12 is a front, isometric, and partially exploded isometric views of linkage components within the operating mechanism.

Referring to FIG. 12, each lower link 194 is interconnected with a crank 208 via a pivotal rivet 210 disposed through an opening 199 in lower link 194 and an opening 209 in crank 208. Each crank 208 pivots about a center 211. Crank 208 has an opening 212 where cross pin 40 (FIG. 2) passes through into arcuate slot 52 of cassettes 32, 34 and 36 (FIG. 2) and a complementary set of arcuate slots 214 on each side frame 86 (FIG. 8).

A spacer 234 is included on each pivotal rivet 210 between each lower link 194 and crank 208. Spacers 234 spread the force loading from lower links 194 to cranks 208 over a wider base, and also reduces friction between lower links 194 and cranks 208, thereby minimizing the likelihood of binding (e.g., when operating mechanism 38 is changed from the "off" position to the "on" position manually or mechanically, or when operating mechanism 38 is changed from the "on" position to the "tripped" position of the release of primary latch 126 and secondary latch 138).

Figure 13:
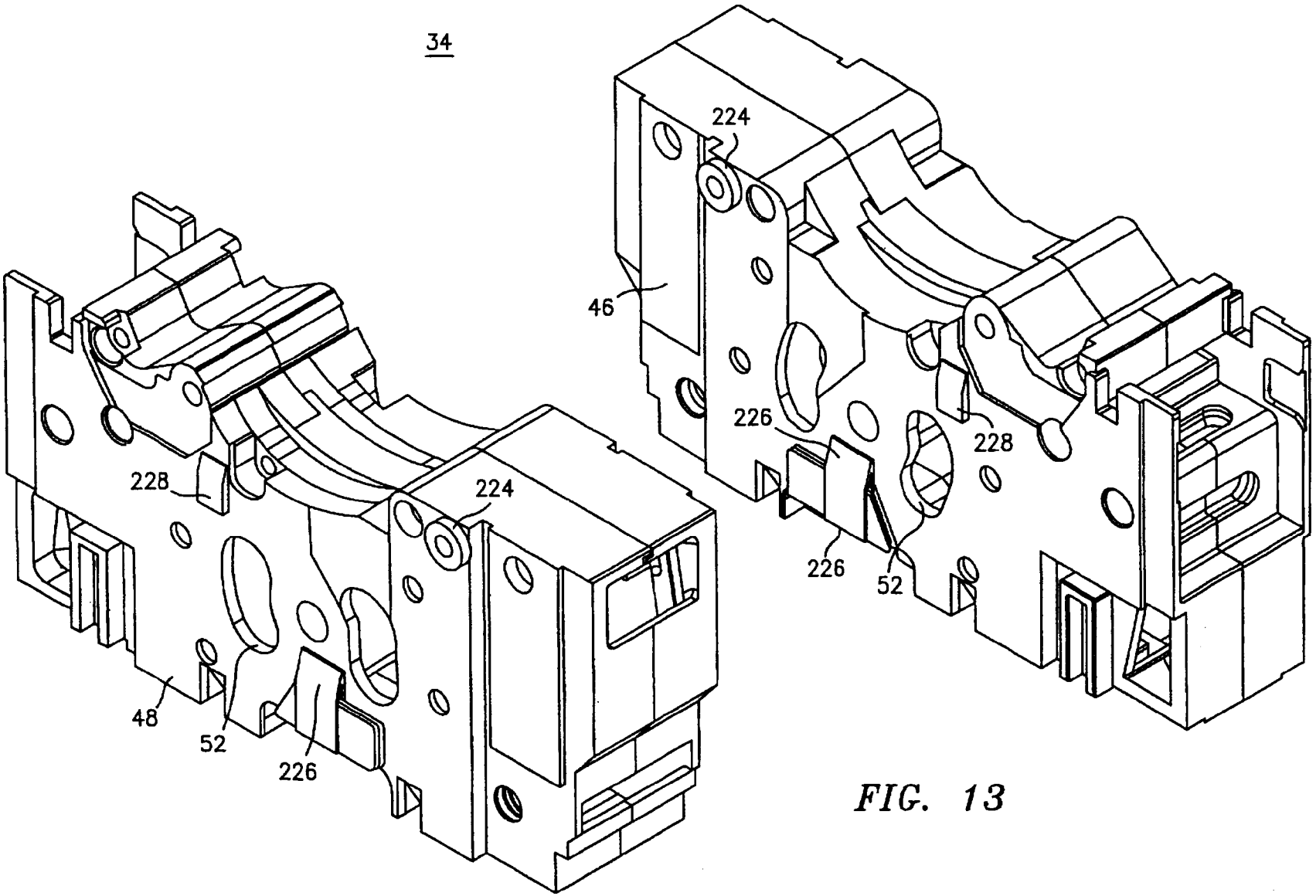
FIGS. 13 depicts isometric views of the opposing sides of a cassette employed within the circuit interrupter.

Referring to FIG. 13, views of both sidewalls 46 and 48 of cassette 34 are depicted. Sidewalls 46 and 48 include protrusions or bosses 224, 226 and 228 thereon. Bosses 224, 226 and 228 are attached to sidewalls 46, 48, or can be molded features on sidewalls 46, 48. Note that cassette 34 is depicted and certain features are described herein because operating mechanism 38 straddles cassette 34, i.e., the central cassette, in circuit breaker 20. It is contemplated that the features may be incorporated in cassettes in other positions, and with or without operating mechanism 38 included thereon, for example, if it is beneficial from a manufacturing standpoint to include the features on all cassettes.

Figure 14:
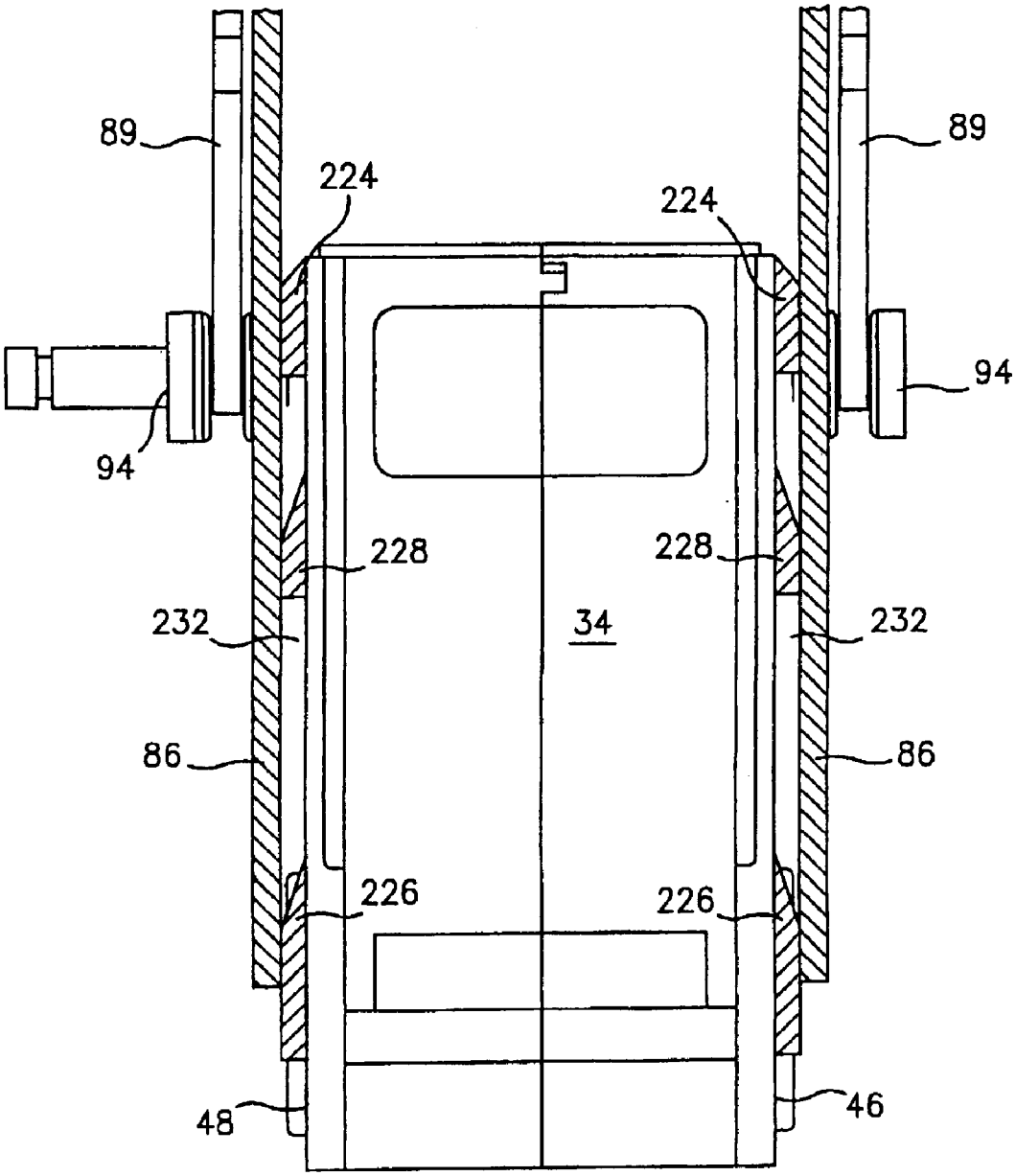
FIG. 14 is a front view of the cassette and the operating mechanism positioned thereon.
Figure 15:
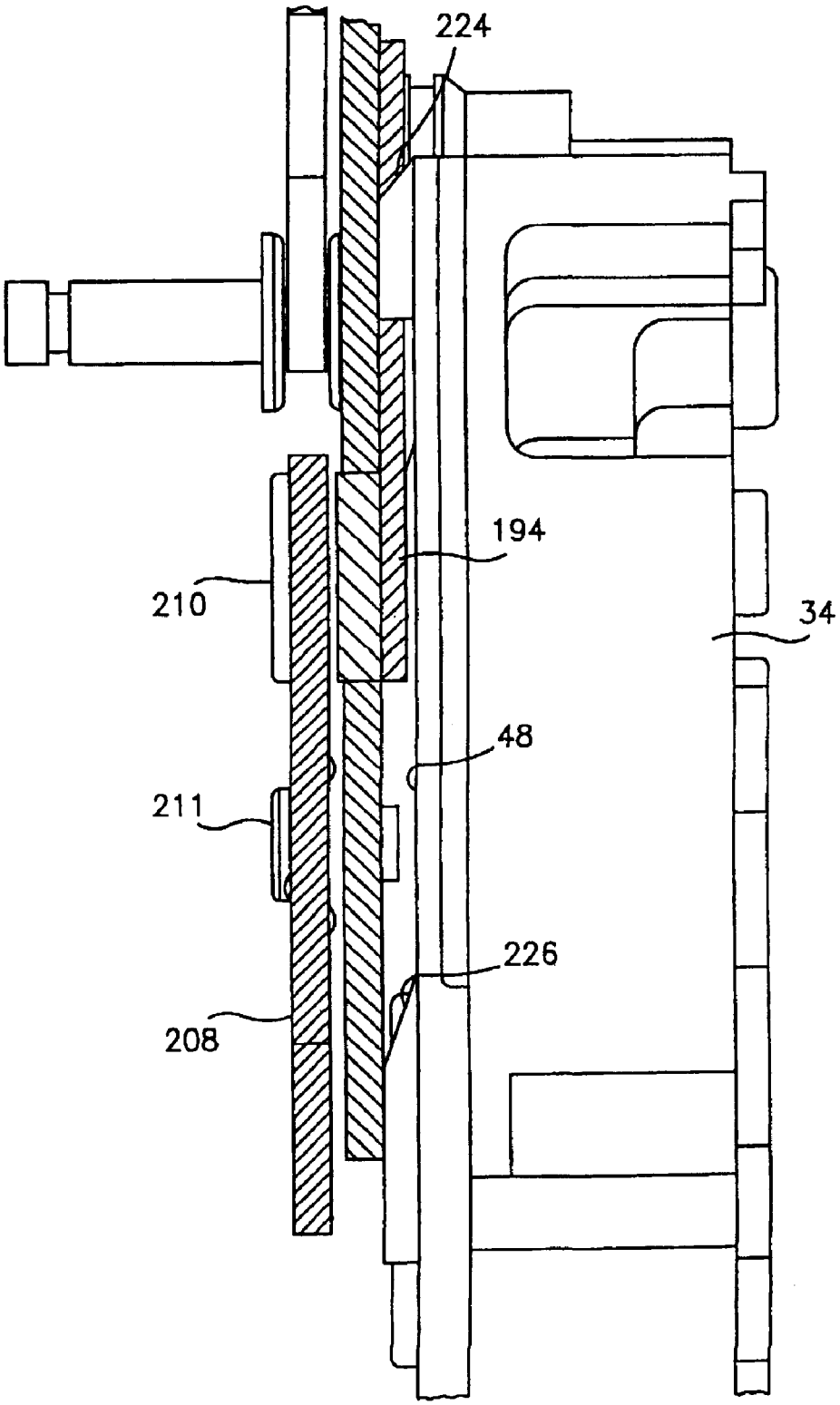
FIG. 15 is a partial front view of the cassette and the operating mechanism positioned thereon.

Referring now to FIG. 14, side frames 86 of operating mechanism 38 are positioned over sidewall 46, 48 of cassette 34. Portions of the inside surfaces of side frames 86 contact bosses 224, 226 and 228, creating a space 232 between each sidewall 46, 48 and each side frame 86. Referring now also to FIG. 15, space 232 allows lower links 194 to properly transmit motion to cranks 208 without binding or hindrance due to frictional interference from sidewalls 46, 48 or side frames 86.

Additionally, the provision of bosses 224, 226 and 228 widens the base of operating mechanism 38, allowing for force to be transmitted with increased stability. Accordingly, bosses 224, 226 and 228 should be dimensioned sufficiently large to allow clearance of links 194 without interfering with adjacent cassettes such as cassettes 32 and 36.

Referring back to FIGS. 3–5, the movement of operating mechanism 38 relative to rotary contact assembly 56 will be detailed.

Referring to FIG. 3, in the "off" position toggle handle 44 is rotated to the left and mechanism springs 96, lower link 194 and crank 208 are positioned to maintain contact arm 68 so that movable contacts 72, 74 remain separated from stationary contacts 64, 66. Operating mechanism 38 becomes set in the "off" position after a reset force properly aligns primary latch 126, secondary latch 138 and cradle 106 (e.g., after operating mechanism 38 has been tripped) and is released. Thus, when the reset force is released, extensions 166 of primary latch 126 rest upon cradle latch surfaces 164, and primary latch surfaces 158 rest upon secondary latch surfaces 162. Each upper link 174 and lower link 194 are bent with respect to each side tube 203. The line of forces generated by mechanism springs 96 (i.e., between spring anchor 98 and pin 202) is to the left of bearing portion 94 (as oriented in FIGS. 3–5). Cam surface 171 of upper link 174 is out of contact with roller 173.

Referring now to FIG. 4, a manual closing force was applied to toggle handle 44 to move it from the "off" position (i.e., FIG. 3) to the "on" position (i.e., to the right as oriented in FIG. 4). While the closing force is applied, upper links 174 rotate within arcuate slots 168 of cradles 106 about pins 188, and lower link 194 is driven to the right under bias of the mechanism spring 96. Raised portions 189 and 192 (FIG. 10) maintain a suitable space between the surfaces of upper links 174 and cradles 106 to prevent friction therebetween, which would increase the required set operating mechanism 38 from "off" to "on". Furthermore, side walls 197 of bearing washers 196 (FIG. 11) maintain the position of upper link 174 on side tube 203 and minimize likelihood of binding (e.g., so as to prevent upper link 174 from shifting into springs 96 or into lower link 194).

To align vertical leg 176 and lower link 194, the line of force generated by mechanism springs 96 is shifted to the right of bearing portion 94, which causes rivet 210 coupling lower link 194 and crank 208 to be driven downwardly and to rotate crank 208 clockwise about center 211. This, in turn, drives cross pin 40 to the upper end of arcuate slot 214. Therefore, the forces transmitted through cross pin 40 to rotary contact assembly 56 via opening 82 drive movable contacts 72, 74 into stationary contacts 64, 66. Each spacer 234 on pivotal rivet 210 (FIGS. 9 and 12) maintain the appropriate distance between lower links 194 and cranks 208 to prevent interference or friction therebetween or from side frames 86.

The interface between primary latch 126 and secondary latch 138 (i.e., between primary latch surface 1 58 and secondary latch surface 162), and between cradles 106 and primary latch 126 (i.e., between extensions 166 and cradle latch surfaces 164) is not affected when a force is applied to toggle handle 44 to change from the "off" position to the "on" position.

Referring now to FIG. 5, in the "tripped" condition, secondary latch trip tab 146 has been displaced (e.g., by an actuator, not shown), and the interface between primary latch 126 and secondary latch 138 is released. Extensions 166 of primary latch 126 are disengaged from cradle latch surfaces 164, and cradles 106 is rotated clockwise about pin 108 (i.e., motion guided by rivet 116 in arcuate slot 118). The movement of cradle 106 transmits a force via rivets 188, 191 to upper link 174 (having cam surface 171). After a short predetermined rotation, cam surface 171 of upper link 174 contacts roller 173. The force resulting from the contact of cam surface 171 on roller 173 causes upper link 174 and lower link 194 to buckle and allows mechanism springs 96 to pull lower link 194 via pin 202. In turn, lower link 194 transmits a force to crank 208 (i.e., via rivet 210), causing crank 208 to rotate counter clockwise about center 211 and drive cross pin 40 to the lower portion of arcuate slot 214. The forces transmitted through cross pin 40 to rotary contact assembly 56 via opening 82 cause movable contacts 72, 74 to separate from stationary contacts 64, 66.

As described above with respect to the setting from "off" to "on", raised portions 189 and 192 (FIG. 10) maintain a suitable space between the surfaces of upper links 174 and cradles 106 to prevent friction therebetween. Furthermore, side walls 197 of bearing washers 196 (FIG. 11) maintain the position of upper link 174 on side tube 203 and minimize likelihood of binding (e.g., so as to prevent upper link 174 from shifting into springs 96 or into lower link 194). Additionally, spacers 234 (FIGS. 9 and 12) maintain the appropriate distance between lower links 194 and cranks 208 to prevent interference or friction therebetween or from side frames 86. By minimizing friction between the movable components (e.g., upper links 174 vis a vis cradles 106, upper links 174 vis a vis lower links 194 and springs 96, and lower links 194 and cranks 208 vis a vis each other and side framed 86), the time to transfer the forces via operating mechanism 38 decreases.

Raised portions 189 and 192, sidewalls 197 of bearing washers 196, and spacers 234 are also suitable to widen the base of operating mechanism 38. This is particularly useful, for example, in an asymmetrical system, where the operating mechanism is disposed on one cassette in a four-pole system.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mechanism for controlling and tripping a separable contact structure within a circuit, said separable contact structure movable between a first and second position, said first position allowing current to flow through said circuit and said second position prohibiting current from flowing through said circuit, said mechanism comprising:

a first support member;

a drive member having a first portion, a second portion, and a third portion, said first portion pivotally attached to said first support member;

a first spring having a first end and a second end, said first end pivotally secured to said drive member second portion and said second end disposed on a drive tube;

a first upper link member having a first portion and a second portion, said first portion disposed on said drive tube;

a first lower link member having a first portion arranged on said drive tube and a second portion interfacing said separable contact structure;

a first release member having a first portion pivotally secured to said first support member, a second portion including said first upper link member pivotally secured thereon, a third portion, and a fourth portion; and a latch assembly having a first portion and a second portion, said first portion configured for coupling and decoupling said third portion of said first release member, said first portion further configured for interfacing said fourth portion of said release member, and said second portion configured for interfacing a displacement mechanism when said displacement mechanism is caused to move to a displaced position;

wherein said mechanism is movable between a reset position, an off position, an on position, and a tripped position, said reset position including a reset force urging said drive member about said first portion such that said third portion of said drive member translates motion to said third portion of said release member, said third portion translates motion to said first portion of said latch assembly to the point where said first portion of said latch assembly is held apart from said fourth portion of said release member;

said off position being achieved upon eliminating said reset force such that said first portion of said latch assembly is coupled to said fourth portion of said release member and said separable contact structure is in its second position;

said on position being achieved upon application of a closing force so that force is transmitted through said drive member to said first spring, said first spring transmitting force via said drive tube to said first upper link member causing said first upper link to pivot on said second portion of said first release member, and said first portion of said first lower link member causing said separable contact structure to move from its second position to its first position via said second portion, said first spring being charged; and said tripped condition being achieved when said displacement mechanism is caused to move to a displaced position and interfaces said second portion of said latch assembly, said interface causing said first portion to decouple said third portion of said first release member, causing said first release member to pivot about said first portion of said first release member thereby causing upper link member to pivot on said second portion of said first release member, said motion of upper link transferring motion to said first lower link member and said first spring causing first spring to discharge and cause first lower link member to urge said separable contact structure from its first position to its second position.

2. A circuit breaker comprising:

a separable contact structure, said separable contact structure movable between a first and second position, said first position allowing current to flow through said circuit breaker and said second position prohibiting current from flowing through said circuit breaker;

a mechanism comprising:

a first support member;

a drive member having a first portion, a second portion, and a third portion, said first portion pivotally attached to said first support member;

a first spring having a first end and a second end, said first end pivotally secured to said drive member second portion and said second end disposed on a drive tube;

a first upper link member having a first portion and a second portion, said first portion disposed on said drive tube;

a first lower link member having a first portion arranged on said drive tube and a second portion interfacing said separable contact structure;

a first release member having a first portion pivotally secured to said first support member, a second portion including said first upper link member pivotally secured thereon, a third portion, and a fourth portion; and a latch assembly having a first portion and a second portion, said first portion configured for coupling and decoupling said third portion of said first release member, said first portion further configured for interfacing said fourth portion of said release member, and said second portion configured for interfacing a displacement mechanism when said displacement mechanism is caused to move to a displaced position;

wherein said mechanism is movable between a reset position, an off position, an on position, and a tripped position, said reset position including a reset force urging said drive member about said first portion such that said third portion of said drive member translates motion to said third portion of said release member, said third portion translates motion to said first portion of said latch assembly to the point where said first portion of said latch assembly is held apart from said fourth portion of said release member;

said off position being achieved upon eliminating said reset force such that said first portion of said latch assembly is coupled to said fourth portion of said release member and said separable contact structure is in its second position;

said on position being achieved upon application of a closing force so that force is transmitted through said drive member to said first spring, said first spring transmitting force via said drive tube to said first upper link member causing said first upper link to pivot on said second portion of said first release member, and said first portion of said first lower link member causing said separable contact structure to move from its second position to its first position via said second portion, said first spring being charged; and said tripped condition being achieved when said displacement mechanism is caused to move to a displaced position and interfaces said second portion of said latch assembly, said interface causing said first portion to decouple said third portion of said first release member, causing said first release member to pivot about said first portion of said first release member thereby causing upper link member to pivot on said second portion of said first release member, said motion of upper link transferring motion to said first lower link member and said first spring causing first spring to discharge and cause first lower link member to urge said separable contact structure from its first position to its second position.

* * * * *